United States Patent [19]

Atalla

[11] Patent Number: 4,515,288

[45] Date of Patent: May 7, 1985

[54] CURRENCY-DISPENSING METHOD AND APPARATUS

[75] Inventor: Martin M. Atalla, Atherton, Calif.

[73] Assignee: Atalla Corporation, San Jose, Calif.

[21] Appl. No.: 446,074

[22] Filed: Dec. 1, 1982

[51] Int. Cl.[3] ..... B65H 5/28

[52] U.S. Cl. ..... 221/1; 221/2; 221/73

[58] Field of Search ..... 221/71–73, 221/1; 271/3; 242/58, 59; 53/591; 194/4 R, 4 C

[56] References Cited

U.S. PATENT DOCUMENTS

| | | | |
|---|---|---|---|
| 3,446,328 | 5/1969 | Boyce et al. | 194/4 R |
| 3,849,968 | 11/1974 | Tateisi | 194/4 R |
| 3,980,006 | 9/1976 | Welch | 221/73 X |
| 4,288,272 | 9/1981 | Pfeffer | 221/73 X |
| 4,337,864 | 7/1982 | McLean | 194/4 R |

FOREIGN PATENT DOCUMENTS

| | | |
|---|---|---|
| 1302819 | 1/1973 | United Kingdom . |
| 1434006 | 4/1976 | United Kingdom . |
| 1448459 | 9/1976 | United Kingdom . |
| 2083004 | 3/1982 | United Kingdom . |
| 2017631 | 6/1982 | United Kingdom . |
| 2109773 | 6/1983 | United Kingdom . |

*Primary Examiner*—Stanley H. Tollberg
*Attorney, Agent, or Firm*—A. C. Smith

[57] ABSTRACT

Units of currency are assembled and packed on a transport medium which is secured within a housing and which is incrementally unpacked under security control to dispense the desired amount of currency. The units of currency are removably attached to the transport medium by isolated, discontinuous adhesive regions on the transport medium that attach the currency thereto in substantially coplanar array with the forward edge unattached to facilitate selective unpacking by non-coplanar manipulation of the transport medium that separates the forward edge of the currency from the transport medium.

9 Claims, 4 Drawing Figures

CURRENCY-DISPENSING METHOD AND APPARATUS

BACKGROUND OF THE INVENTION

Vending machines are commonly used to dispense diverse types and forms of goods, and such machines have even been adapted to dispense packets of cash in predetermined amounts. The popularity of dispensing cash packets seems to be attributable to the simplicity of debiting fixed amounts and to the convenience of using dispensing technology which is similar to the technology used in dispensing such packaged goods as cigarettes and candy bars. Machines of this type are disclosed in the literature (see, for example, U.S. Pat. Nos. 3,662,343 and 3,845,277). One disadvantage associated with conventional cash-dispensing machines is that the packets of cash remain highly vulnerable to pilferage in the course of manually inserting cash into packets and in the course of loading packets into the dispensing machines.

It is highly desirable to obviate the manual handling of cash (or other forms of money, like traveler's checks, etc.) in the preparation of the cash for dispensing and in the loading of the cash supply into a dispenser. Also, it is highly desirable to dispense cash (or currency, generally) in arbitrary amounts for greater versatility and accounting possibilities with respect to a recipient's own account balance.

SUMMARY OF THE INVENTION

In accordance with the present invention, cash or other currency to be dispensed is packaged automatically under secured conditions in continuous array on a transport medium which is assembled within a secure housing to form a currency cartridge which can only be operated under coded control to dispense arbitrary amounts of currency, as desired by users.

DESCRIPTION OF THE PREFERRED EMBODIMENT

Figure 1:
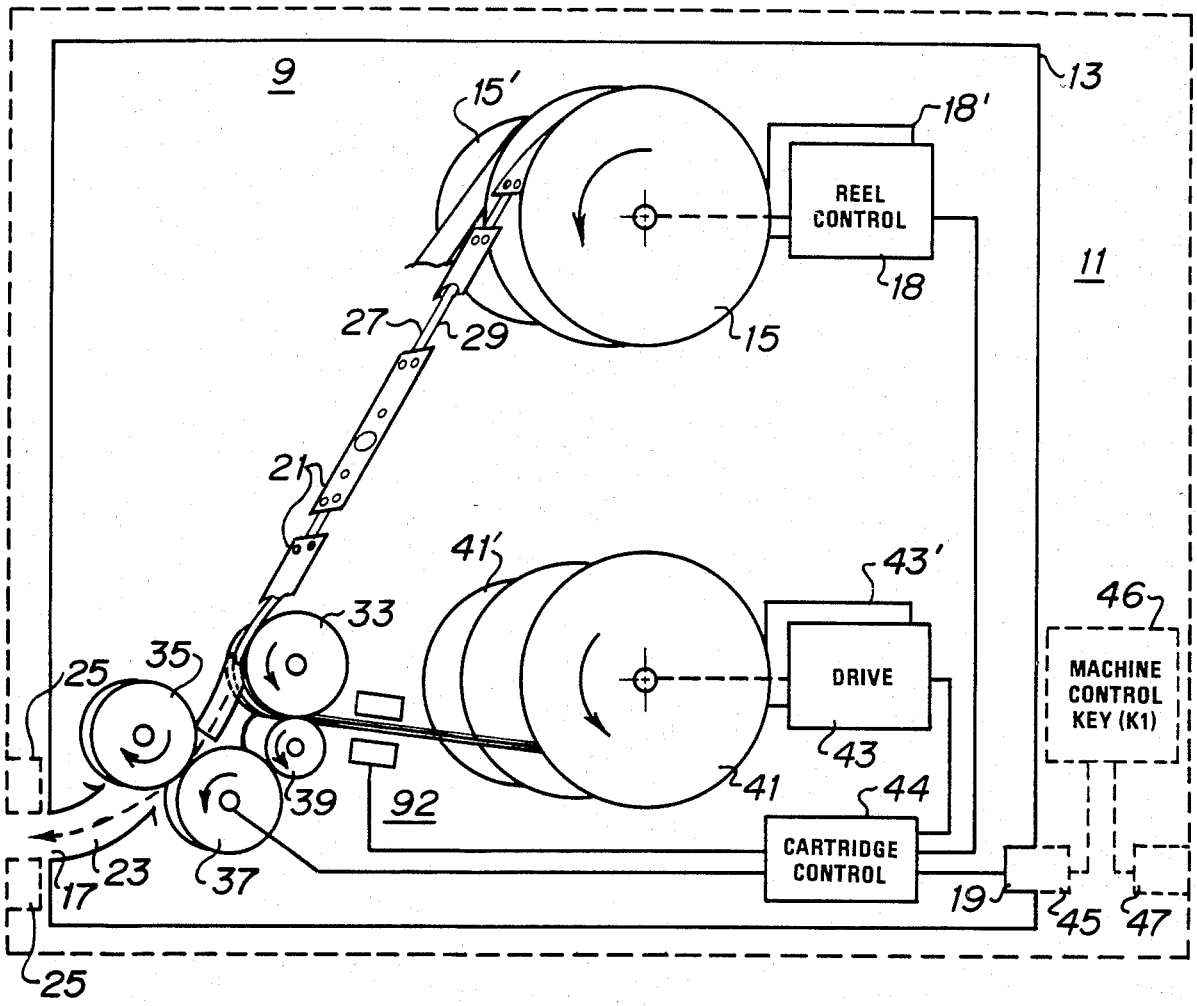
FIG. 1 is a pictorial view of a currency cartridge showing the operating relationships of the structure.

Referring now to FIG. 1, there is shown a pictorial diagram of a currency cartridge 9 installed within a dispensing machine 11. The currency cartridge 9 is contained within a housing 13 which completely surrounds and encloses the reel supply 15 of currency and the operating components, later described herein, to form a secure cartridge that has only an exit port 17 for currency and a connector 19 for control signals. Units of currency 21 which are to be dispensed pass through an exit chute 23 and exit port 17 of the cartridge 13, and through a security port 25 of the machine 11 which is designed using conventional technology to eject dispensed currency and to inhibit unauthorized intrusion by foreign objects.

Figure 2:
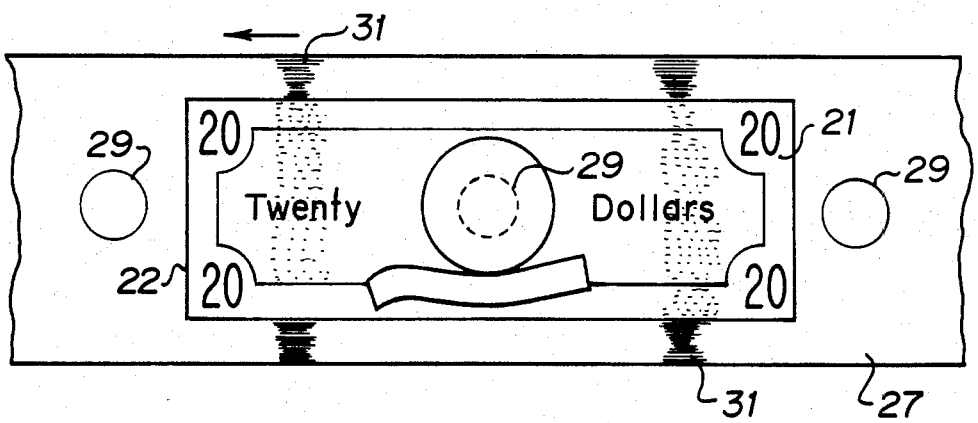
FIG. 2 is a perspective view of a transport medium and attached unit of currency.

The reel supply 15 of currency 21 includes a transport medium or web 27 of material such as Mylar or paper, or the like, of high tensile strength which has detector apertures 29 disposed at regular increments along the length of the medium 27. As shown more specifically in FIG. 2, the medium 27 (which may be wider or narrower than the currency unit) includes adhesive regions 31 positioned at regular increments along the length of the medium at locations relative to the detector apertures 29 which facilitate attaching each unit of currency 21 to the medium 27 in registration over a corresponding aperture 29. The length of transport medium 27 with units of currency 21 adhesively (but removably) attached thereto is wound onto reel 15 or otherwise packed (as by zig-zag stacking, or the like) for selective unwinding or unpacking of the units of currency, as required to dispense the units 21. The medium 27 is attached to each unit of currency 21, as by conventional gummy, pressure-sensitive adhesive, at a location on each unit that is remote or back from the leading edge 22. Thus, the unit of currency 21 lays substantially in parallel-plane relationship to the medium 27 (referred to herein as coplanar relationship) can be "peeled" off the medium 27 by bending the medium 27 away from the unit 21. This bending is accomplished by moving the medium 27 over roller 33. Because of the inherent rigidity of paper currency units 21 (even in used units), the leading edge 22 of a unit 21 "peels" away from medium 27 as it passes over roller 33 and can be gripped by a pair of rollers 35, 37 which exerts a continuing force on the unit 21 in a direction that diverges or strips away from the direction of movement of medium 27. An idler roller 39 may be mounted to pinch the medium 27 against roller 33 and to drive the rollers 35, 37 so that the surface velocities of these moving elements are the same and are controlled by the take-up reel 41 and the drive 43 coupled thereto. A unit of currency 21 which is thus stripped or peeled away from the medium 27 is ejected through the exit chute 23 and exit port 17 of the cartridge and can be transported through a conventional security port 25 of the machine 11 to the recipient. The incremental length of medium 27 moved sufficiently to eject one currency unit 21 is wound onto take-up reel 41.

Of course, more than one supply reel 15, 15' may be included within the same cartridge 13 where it is desirable to dispense currencies in combinations of different denominations. In that event, one supply reel 15, 15' contains currency units of a different denomination than is contained in other supply reels and each such supply reel of currency units is included within an independently operable system of elements (deleted for clarity) similar to the one system described herein in connection with reels 15, 41, rollers 33, 35, 37, 39, etc. Also, it should be recognized that paper money, scrip, traveler's checks, coins and other tokens of value should be considered in the term currency as used herein.

Figure 3:
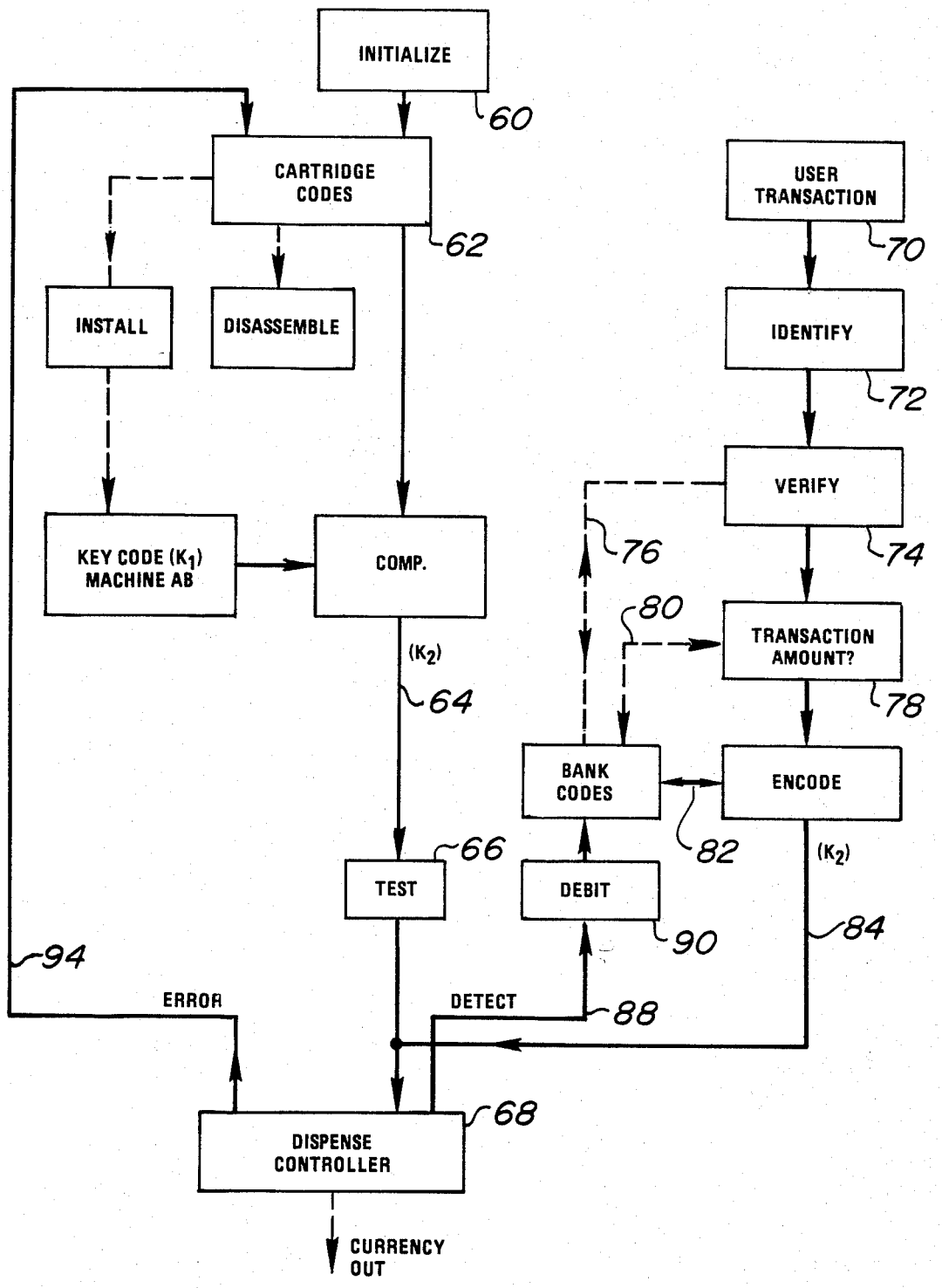
FIG. 3 is a flow chart showing the logical control of the currency cartridge.

The take-up reel 41 and drive means 43 coupled thereto are operated incrementally in response to signals supplied by the cartridge control 44. As illustrated in the flow chart of FIG. 3, operation of the cartridge 13 may be in response to an initializing mode or a user-transaction mode. In the initializing mode 60, a cartrige 13 newly prepared with units of currency, as later described in connection with FIG. 4, may be scheduled to be installed in a selected machine 11 which has a known key code ($K_1$) associated therewith. The cartridge control 44 may be encoded 62 in conventional manner to include a security code which renders the cartridge 13 operable 64 only when installed in machine 11 and properly connected to its control 46 via connectors 19, 45. To establish the proper installation and operation of a cartridge 13, the assembly may be tested 66 under control of cartridge control 44 and machine control 46 to dispense 68 the first unit of "currency" from the supply reel 15, which first unit may be dummy currency that is actually a receipt to evidence proper installation of the cartrige 13 in the selected machine 11.

In the user transaction mode 70, a user who was previously identified by the bank or other proprietor of the currency dispensing machine 11 and who has an account on file can identify himself 72 by his own code word at the location of machine 11 using conventional interface means 47 such as credit-card reader, keyboard, etc. The user's identity may then be verified 74, either off-line or in interactive connection 76 with the bank, using conventional algorithms, for example, as disclosed in U.S. Pat. No. 3,938,091 or 4,328,414. Once the identity of the user is verified, his requested amount of currency 78 may be checked at the bank 80 against the credit balance standing in his account, and the requisite control code 84 may be supplied to the cartridge control 44 to dispense 68 the requested amount of currency.

Cartridge control 44 thus is activated to perform several functions. The reel control 18, which locks the supply reel 15 against rotation, is activated to release or drive reel 15 to unwind the transport medium 27 with attached currency. In addition, take-up reel 41 is rotated by drive means 43 to wind up the transport medium 27. This motion of transport medium 27 continues until one or more units of currency sufficient to total the requested amount are "peeled" off the medium and dispensed.

To assure a proper accounting for the amount of currency actually dispensed, the pair of gripping rollers 35, 37 may be conductive and normally operated in conductive relationship to each other so that their conductive connection is interrupted as a unit of currency is being rolled through. This detection signal 88 (which can also be generated by optical or other suitable means) is indicative of currency actually dispensed and is used to initiate a debit 90 of the user's account. Of course, similar operation of other supply reels of currency of different denominations can also be controlled by cartridge control 44 in order to dispense a wider variety of amounts of currency consistent with an identified user's outstanding account credits.

If a unit of currency 21 is not peeled off the medium 27 after it moves around roller 33, the error detector 92, which may include an optical source and detector, will indicate that the unit is still in position on the medium covering the associated aperture 29. In this event, no unit of currency would have been dispensed (or debited), as expected, and the unit of currency may simply be wound onto the take-up reel 41 as the drive means 43 continues to move the medium 27 an additional distance sufficient to dispense the required unit or units of currency. However, in accordance with one embodiment of the present invention, this detected error 94 in the operation of the cartridge 13 is applied to alter the cartridge code in a manner which indicates that currency is still contained within the cartridge. When the cartridge is later removed from machine 11 and returned to the bank for disassembly and reloading, this altered code may be detected via connector 19 as an indication that disassembly requires retrieval of currency in take-up reel 41.

Figure 4:
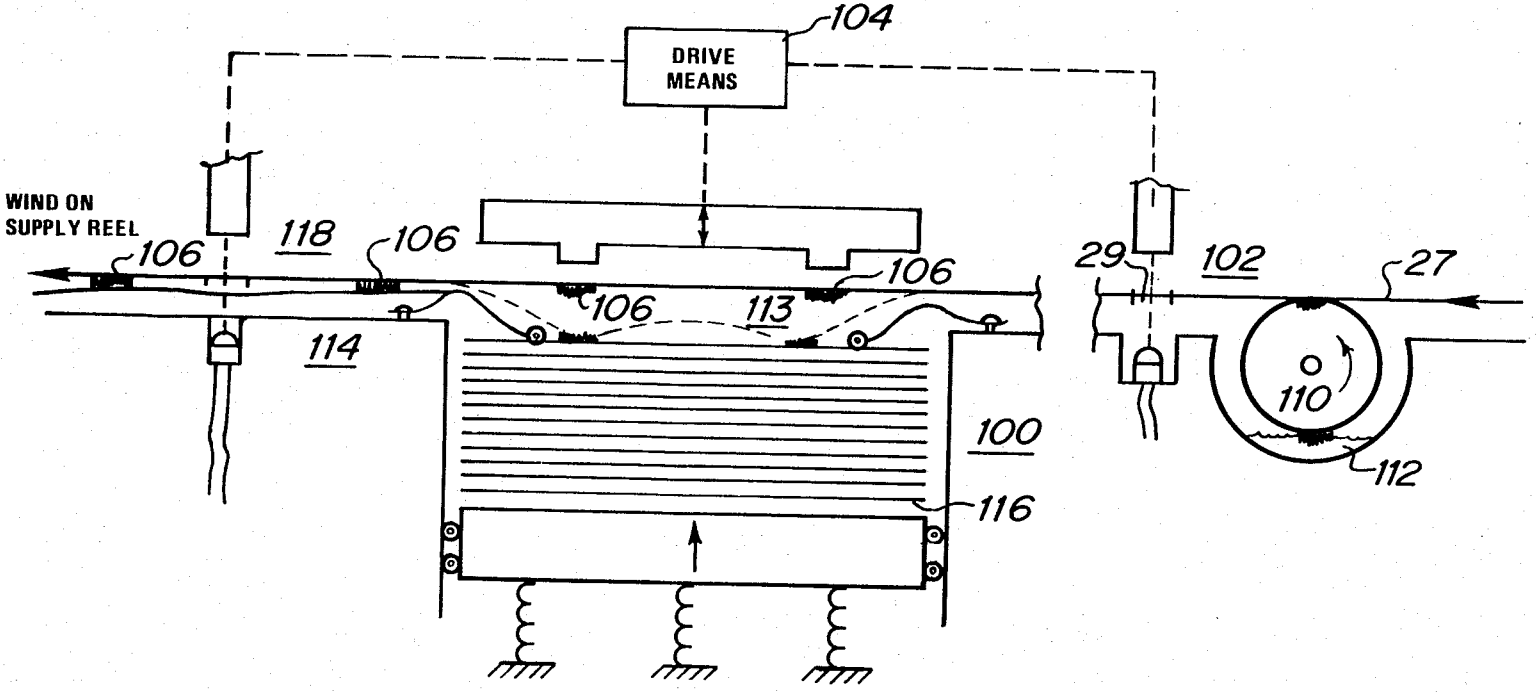
FIG. 4 is a pictorial view of apparatus for preparing units of currency for dispensing from the transport medium.

Referring now to FIG. 4, there is shown a work station at which a supply 100 of currency units is automatically assembled or stacked on the transport medium 27. Adhesive regions 106 are formed at regular intervals along the medium by roller 110 having raised applicator protrusions around its perimeter which pick up adhesive 112 and apply it as a lateral stripe 106 to the medium 27. Conventional, pressure-sensitive, gummy adhesives for this application are commonly available, for example, from 3M Company, Minnesota, and can be applied in continuous operation as disclosed. This adhesive adequately holds a unit of currency in gummy fixation upon the medium for easy "peeling" therefrom without damage to the currency.

A light source and detector 102 at the entrance side of the work station aligns with the apertures 29 and activates the drive means 104 to press the medium 27 with adhesive regions 106 onto the top unit of currency in the supply 100, as illustrated at 113. By this action, the top unit adheres to the medium 27 in position over the associated aperture 29 and with the leading edge (relative to the illustrated direction of movement of the medium 27) well in advance of the adhesive region 106. The units of currency are thus stacked on the medium 27 substantially in parallel-plane relationship 114 to the medium 27. The leading edge or forward boundary of each unit of currency is thus free to "peel" away from the medium 27 when the medium 27 is moved over roller 33, as previously described. The last unit of "currency" 116 attached to the medium 27 may be dummy currency or a receipt for test operation of the cartridge 13, as previously described. Light source and detector 118 may be located on the outlet side of the work station in alignment with the apertures 29 to provide error signal to the drive means 104 for suitably altering its operation in response to detection of an aperture 29 not covered by an adhered unit of currency.

Therefore, the currency dispenser and method of the present invention provide units of currency to users at remote locations under conditions that insure high degrees of security upon installation and operation. In addition, currency-dispensing cartridges according to the present invention may directly supply units of currency in different selected denominations for greater versatility compared with conventional prepackaged packets of currency.

I claim:

1. Currency-dispensing apparatus comprising:

a transport medium;

a supply of currency units adhesively attached to said transport medium in substantially coplanar relationship therewith at successive locations therealong, with each adhesive attachment of a currency unit being disposed at at least one isolated, discontinuous region that is spaced inwardly from a forward edge of the currency unit;

a work station for altering the coplanar relationship of the transport medium and currency attached thereto for separating the forward edge of a currency unit from said transport medium in advance of encountering said region of adhesive attachment therealong;

motive drive control means for selectively advancing the transport medium through the work station in response to applied electrical control signals to separate the currency unit from the transport medium at said region of adhesive attachment; and detector means including conductive roller means disposed in conductive contact, said conductive roller means positioned relative to said work station to receive therebetween a currency unit separated from the transport medium to produce in response thereto a detector signal which is indicative of a currency unit being separated from the transport medium.

2. Currency-dispensing apparatus comprising:

a transport medium;

a supply of currency units adhesively attached to said transport medium in substantially coplanar relationship therewith at successive locations therealong, with each adhesive attachment of a currency unit being disposed at at least one isolated, discontinuous region that is spaced inwardly from a forward edge of the currency unit;

a work station for altering the coplanar relationship of the transport medium and currency attached thereto for separating the forward edge of a currency unit from said transport medium in advance of encountering said region of adhesive attachment therealong;

motive drive control means for selectively advancing the transport medium through the work station in response to applied electrical control signals to separate the currency unit from the transport medium at said region of adhesive attachment;

take-up means positioned relative to the work station for accepting the transport medium which passed therethrough; and sensing means positioned relative to the work station and take-up means along the path of the transport medium therebetween for producing a sense signal in response to a currency unit remaining attached to the transport medium past said work station.

3. Currency-dispensing apparatus comprising:

a length of transport medium having isolated adhesive regions therealong and having individual units of the currency to be dispensed attached thereto at said adhesive regions with at least one edge of each unit of currency to be dispensed unattached to the transport medium;

reel means having said length of transport medium wound thereon; and said units of currency to be dispensed are attached to said transport medium at said adhesive regions with said one edge of each unit being the leading boundary edge thereof for motion of the transport medium in the direction of unwind from said reel means;

a housing means completely surrounding the reel means, and having an outlet port therein for ejecting units of currency therethrough; and motive drive control means mounted within the housing means and operatively attached to said reel means for selectively ejecting units of currency through said outlet port in response to electrical control signals applied thereto.

4. Apparatus to prepare units of currency for selective dispensing, comprising:

supply means of a length of transport medium having isolated adhesive regions disposed therealong;

take-up means for the length of transport medium;

a work station disposed intermediate the supply means and the take-up means along a path of movement of the transport medium therebetween, said work station including a supply of units of the currency to be dispensed disposed on the side of the transport medium adjacent the adhesive regions therealong, and including on the opposite side of the transport medium platen means for intermittently applying pressure to the transport medium at selected locations therealong to contact an adhesive region with a unit of currency at a location thereon which is interior of at least one boundary edge thereof; and means for moving the transport medium along the path thereof from the supply means through the work station to the take-up means for attaching a plural number of units of currency to be dispensed at intervals along the length of the transport medium.

5. Apparatus as in claim 4 wherein said supply means includes means disposed intermediate the supply means and the work station along the path of movement of the transport medium therebetween for applying adhesive to isolated regions on one surface of the transport medium.

6. Apparatus as in claim 4 comprising detector means mounted intermediate the work station and the take-up means along the path of the transport medium therebetween for producing a signal indicative of the attachment of a unit of currency to the transport medium.

7. Method of manipulating units of currency to be dispensed selectively, from a transport medium, the method comprising:

removably adhesively attaching units of currency at successive locations along the length of the transport medium in substantially coplanar relationship therewith with each adhesive attachment of a currency unit being disposed at at least one isolated, discontinuous region that is spaced inwardly from a forward edge of the currency unit;

packing the transport medium with attached units of currency for selective unpacking thereof to sequentially remove from the successive locations between initial and terminal locations along the length of the transport medium each unit of currency by the unattached forward edge thereof; and removably attaching at least one unit of dummy currency at a location near an extreme of the length of transport medium which is unpacked initially.

8. Method as in claim 7 to dispense currency from a selected machine having a control code associated therewith, the method comprising the steps of assigning code information to the pack of the transport medium with attached units of currency;

installing the pack in the selected machine; and selectively unpacking the transport medium to separate at least the one unit of dummy currency in response to the logical combination of the control code of the machine and the code information of the pack.

9. Currency-dispensing apparatus as in claim 2 comprising code means responsive to said sense signal for retaining a code therein that is indicative of a unit of currency remaining within the take-up means.

* * * * *